US006730649B2

(12) United States Patent
Metcalfe et al.

(10) Patent No.: US 6,730,649 B2
(45) **Date of Patent: *May 4, 2004**

(54) DETERGENT COMPOSITIONS

(75) Inventors: Kenneth Metcalfe, Wirral (GB); Vincent Charles Mole, Wirral (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/025,244

(22) Filed: Dec. 19, 2001

(65) Prior Publication Data

US 2002/0155974 A1 Oct. 24, 2002

(30) Foreign Application Priority Data

Dec. 29, 2000 (GB) ..... 0031823

(51) Int. Cl.[7] ..... C11D 1/29; C11D 1/62; C11D 1/65; C11D 3/02

(52) U.S. Cl. ..... 510/341; 510/350; 510/351; 510/352; 510/357; 510/359; 510/361; 510/504

(58) Field of Search ..... 510/336, 340, 510/341, 350, 351, 352, 357, 359, 361, 504

(56) References Cited

U.S. PATENT DOCUMENTS

| | | | | |
|---|---|---|---|---|
| 3,959,155 | A | 5/1976 | Montgomery et al. | 252/8.8 |
| 4,265,777 | A | 5/1981 | Boyer et al. | 252/113 |
| 4,272,395 | A | 6/1981 | Wright | 252/106 |
| 4,664,839 | A | 5/1987 | Rieck | 252/175 |
| 4,686,063 | A | 8/1987 | Burns | 252/102 |
| 4,751,015 | A | 6/1988 | Humphreys et al. | 252/99 |
| 4,810,409 | A | 3/1989 | Harrison et al. | 252/102 |
| 4,818,426 | A | 4/1989 | Humphreys et al. | 252/99 |
| 4,820,439 | A | 4/1989 | Rieck | 252/135 |
| 4,970,017 | A | 11/1990 | Nakamura et al. | 252/174.13 |
| 5,397,501 | A | 3/1995 | Coope | 252/186.42 |
| 5,415,812 | A | 5/1995 | Durbut et al. | 252/547 |
| 5,728,667 | A | 3/1998 | Richter | 510/235 |
| 5,798,329 | A | 8/1998 | Taylor et al. | 510/384 |
| 6,010,996 | A | 1/2000 | Hu et al. | 510/384 |
| 6,345,633 | B1 * | 2/2002 | Tartakovsky et al. | 134/25.2 |
| 6,350,725 | B1 * | 2/2002 | Levitt et al. | 510/189 |

FOREIGN PATENT DOCUMENTS

| | | | |
|---|---|---|---|
| DE | 38 23 172 | | 1/1990 |
| EP | 133 900 | | 3/1985 |
| EP | 164 514 | | 12/1985 |
| EP | 284 292 | | 9/1988 |
| EP | 303 520 | | 2/1989 |
| EP | 325 288 | | 7/1989 |
| EP | 325 289 | | 7/1989 |
| EP | 349 940 | | 1/1990 |
| EP | 384 070 | | 8/1990 |
| EP | 402 971 | | 12/1990 |
| EP | 405 967 | | 1/1991 |
| EP | 458 397 | | 11/1991 |
| EP | 460 925 | | 12/1991 |
| EP | 509 787 | | 10/1992 |
| GB | 1 336 556 | | 11/1973 |
| GB | 1 429 143 | | 3/1976 |
| GB | 1 437 950 | | 6/1976 |
| GB | 1 470 250 | | 4/1977 |
| GB | 1 473 201 | | 5/1977 |
| GB | 1 473 202 | | 5/1977 |
| GB | 1 570 128 | | 6/1980 |
| GB | 2309706 | * | 8/1997 |
| GB | 2 309 706 | | 8/1997 |
| GB | 2 338 242 | | 12/1999 |
| WO | 97/43366 | | 11/1997 |
| WO | 98/01521 | | 1/1998 |
| WO | WO 09/17759 | * | 4/1998 |
| WO | 98/17759 | | 4/1998 |
| WO | 98/35002 | | 8/1998 |
| WO | WO 98/35002 | * | 9/1998 |
| WO | 98/38280 | | 9/1998 |
| WO | 99/20734 | | 4/1999 |
| WO | 00/40682 | | 7/2000 |
| WO | WO00/43477 | * | 7/2000 |
| WO | 02/21916 | | 3/2002 |

OTHER PUBLICATIONS

PCT International Search Report in a PCT application PCT/EP 01/14766 Dec. 2001.

PCT International Search Report in a PCT application PCT/EP 01/14763 Dec. 2001.

GB Search Report in a GB application GB 9601904.7 Mar. 1996.

Japanese Abstract of JP 09–87690—published Mar. 31, 1997.

Derwent Abstract of JP 62 218499—published Sep. 25, 1987.

Co–pending Application: Applicant—Van der Hoeven et al., Ser. No.—10/025,238; Filed: Dec. 19, 2001.

GB Search Report in a GB application: GB 0031823.8. date Jun. 2000.

Derwent Abstract of DE 38 23 172. date Jul. 1988.

* cited by examiner

*Primary Examiner*—Gregory Delcotto
(74) *Attorney, Agent, or Firm*—Rimma Mitelman

(57) ABSTRACT

A detergent composition comprising:

(a) at least 5 wt % of a calcium-tolerant non-soap anionic surfactant system which comprises an alpha-olefin sulphonate;

(b) at least 0.1 wt % of a cationic surfactant system in a weight ratio of (a):(b) of from 17:3 to 9:10, preferably from 3:1 to 1:1; and (c) the balance, if any, being other detergent ingredients.

7 Claims, No Drawings

DETERGENT COMPOSITIONS

TECHNICAL FIELD

The present invention relates to a laundry detergent composition, which may, for example, be formulated as a particulate, tablet or liquid composition.

BACKGROUND TO THE INVENTION

Conventional laundry detergent powders intended for the handwash contain a substantial level of anionic surfactant, most usually alkylbenzene sulphonate. Anionic surfactants are ideally suited to the handwash because they combine excellent detergency on a wide range of soils with high foaming.

However, event at high levels of anionic surfactant, for handwashing, the oily soil removal performance of such products is in need of improvement.

GB-A-1 570 128 discloses detergent compositions comprising from 4 to 40 wt % of a magnesium-insensitive surfactant (for example, alkyl ether sulphate, ethoxylated nonionic surfactant, amine oxide), from 13 to 40 wt % of sodium silicate, and from 5 to 50 wt % of a magnesium-selective detergency builder (for example, zeolite, sodium citrate, nitrilotriacetate, or calcite/carbonate).

JP-A-09 087 690 discloses a high-bulk-density granular detergent composition for machine wash use, containing anionic (5 to 40 wt %), plus ethoxylated nonionic surfactant (1 to 15 wt %), zeolite (10 to 40 wt %), and crystalline and amorphous sodium silicates (0.5 to 10 wt %). The anionic surfactant optionally contains alpha-olefin sulphonate (up to 10 wt % in the examples).

WO-A-97/43366 relates to detergent composition comprising from 0.5% to 60% by weight an anionic surfactant and from 0.01% to 30% by weight of a cationic surfactant. In the exemplified compositions in this document, the level of anionic surfactant is typically from about 10% to 15% by weight of the composition and the amount of cationic surfactant is from about 1% to 4% by weight. In some examples, the anionic surfactant component contains small amounts of an alkyl ether sulphate surfactant, typically at from 0.76% to 2.5% by weight of the total composition.

Compositions with small amounts of alkyl ether sulphate anionic surfactant (up to-1.75 wt %) and in one case, a low amount of zeolite (1.5 wt %) are disclosed in WO-A-98/01521. However, these compositions are spray-dried and therefore have high amounts of sodium sulphate which is a non-alkaline non-functional water-soluble salt (electrolyte).

Other spray-dried compositions with high levels of sodium sulphate and containing alpha-olefin sulphate anionic surfactant, together with 12 or 15 wt % zeolite builder are disclosed in JP-A-62 218499.

WO-A-00/40682 discloses compositions comprising more than 40% of an anionic surfactant system at least some comprising a calcium tolerant surfactant such as an alpha-olefin sulphonate or alkyl ether sulphate. The examples with calcium tolerant surfactant either contain no phosphate or aluminosilicate builder or else a very high level of phosphate.

Our UK Patent Application No. 9925961.6 also discloses compositions with 5–30 wt % of alpha-olefin sulphonate. These are all based on a calcite/carbonate builder system.

Other compositions containing calcium tolerant surfactants are disclosed in U.S. Pat. No. 6,010,996, GB-A-2 309 706, U.S. Pat. No. 5,415,812, U.S. Pat. No. 4,265,777 and U.S. Pat. No. 4,970,017.

There remains a need, fulfilled by the present invention, for compositions which contain a strong builder, namely a phosphate or aluminosilicate builder, but at lower levels, yet which are still robust across a wide range of water hardness.

DEFINITION OF THE INVENTION

The present invention provides a detergent composition comprising:

(a) at least 5 wt % of a calcium-tolerant non-soap anionic surfactant system which comprises an alpha-olefin sulphonate;

(b) at least 0.1 wt % of a cationic surfactant system in a weight ratio of (a):(b) of from 17:3 to 9:10, preferably from 3:1 to 1:1;and (c) the balance, if any, being other detergent ingredients.

DETAILED DESCRIPTION OF THE INVENTION

The composition of the invention is based on mixed calcium tolerant anionic surfactant systems, plus moderate amounts of phosphate and/or aluminosilicate builder.

The Anionic Surfactant System (a)

The composition of the invention contains at least 5 wt % of calcium tolerant anionic surfactant comprising an alpha-olefin sulphonate. Typically, the upper level of this calcium tolerant anionic surfactant system will be 75 wt %. However, preferably, the anionic surfactant system is present at from 15 wt % to 70 wt %, more preferably from 2 wt % to 60 wt %, especially from 30 wt % to 50 wt % based on the weight of the total composition.

The calcium ion stability of anionic surfactants can be measured by the modified Hart method (Witkes, et al. J. Ind. Encl. Chem. 29, 1234–1239 (1937)), carried in microtiter plates. The surfactant solution is titrated with a calcium ion solution. The onset of turbidity indicates the start of formation of insoluble calcium precipitates after a minute of shaking at room temperature.

As referred to herein, a "calcium tolerant" surfactant is one that does not precipitate at a surfactant concentration of 0.4 g/L (and at a ionic strength of a 0.040 M 1:1 salt solution at) with a calcium concentration up to 20° FH (French hardness degrees), i.e. 200 ppm calcium.

An essential non-soap calcium tolerant anionic surfactant for use in the compositions of the present invention is alpha-olefin sulphonate.

Advantageously one or more other calcium tolerant anionic surfactant alkyl ether sulphate (another non-soap calcium tolerant material) may be present, in an amount less that that of the alpha-olefin sulphonate.

A preferred surfactant system comprises alpha-olefin sulphonate and alkyl ether sulphate in a weight ratio of from 5:1 to 15:1.

Other calcium-tolerant anionic surfactants that may be used in addition to the alpha-olefin sulphonate acid alone or in combination with these or other calcium-tolerant anionics are alkyl ethoxy carboxylate surfactants (for example, Neodox (Trade Mark) ex Shell), fatty acid ester sulphonates (for example, FAES MC-48 and ML-40 ex Stepan), alkyl xylene sulphonates, dialkyl sulphosuccinates, fatty acid ester sulphonates, alkyl amide sulphates, sorpholipids, alkyl glycoside sulphates and alkali metal (e.g. sodium ) salts of saturated or unsaturated fatty acids.

More than one other anionic surfactants may also be present. These may for example be selected from one or more of alkylbenzene sulphonates, primary and secondary alkyl sulphates.

When it is desired to avoid the calcium intolerance of alkylbenzene sulphonate surfactant altogether, then the anionic surfactant system may comprise (preferably at a level of 70 wt % or more of the total anionic surfactant) or consist only of one or more calcium-tolerant non-soap anionic surfactants.

Cationic Surfactant Systems

The compositions of the present invention contain at least 0.1% by weight of the cationic surfactant system. Typically, the cationic surfactant system may be present at up to 15 wt % of the total composition. However, it preferably is present at from 0.5 wt % to 5 wt % at the composition.

Preferred cationic surfactant types include those having the formula:

R1R2R3R4N+X— wherein

R1=is a hydrophobic group (preferably) C12–14 alkyl, or derived from Coco;

R2, R3 or R4 are independently hydroxyethyl, hydroxypropyl or C1–4 alkyl (e.g. Me, Et) group;

X—is a solubilising cation, preferably Cl—, Br—or $MeSO4^-$

Specific examples are:

| | R1 | R2, R3, R4 |
|---|---|---|
| (i) alkyl hydroxyethyl dimethylammonium chloride HoeS3996 (now sold as Praepagen HY) (ex Clariant, prev. Hoechst) | C12 | 2 methyl, 1 hydroxyethyl |
| (ii) Alkyl dihydroxyethyl methylammonium chloride Bis-AQA types (ex Clariant) e.g. Ethoquad C/12 type (AKZO-Nobel) | C12 | 1 methyl, 2-hydroxyethyl |
| (iii) alkyl trimethyl ammonium chloride Arquad types (eg. Arquad C33W) | <C16 pref. C12 | 3 methyl |

The definition of cationic surfactants also include QMEA (quaternised monoethanolamine) or QTEA (quaternised triethanolamine). Quaternisation can arise as the result of neutralisation in situ of MEA or TEA by a surfactant acid (i.e. LAS acid, fatty acid, paraffin sulphonic acid=SAS acid, etc):

| | RI | R2, R3, R4 |
|---|---|---|
| (iv) mono-hydroxyethyl ammonium chloride Quaternised MEA hydroxyethyl | H | 2 H, 1 |
| (v) tri-hydroxyethyl ammonium chloride Quaternised TEA | 1-hydroxyethyl | 1 H, 2-hydroxyethyl |

The physical form of the amines is water-like liquid. They could be either applied in the slurry for powder making (as an alkali replacing caustic soda partly) or in a post-dosed granule adjunct and present as a counter-ion after the neutralisation of a surfactant acid.

(vi). APA Quats: Alkyl amido-N-propylene dimethyl (quarternary-)ammonium chloride (alkyl-CON(X)—(CH2)3NH+(CH3)2 Cl—where X=H or Me, Et, Pr or higher) APA Quats C12–C14—CON(X)(CH2)3 2 methyl (vii) Alcohol triethoxy dimethyl ammonium chloride (alkyl (EO)n N+(CH3)3 Cl—, where n is 1–10

(viii) Esterquats: Mono or di (cocoyl-ethylene) hydroxyethyl methylammonium chloride (Cocoyl(CH2)2N+(CH3)(CH2CH2OH) CH3SO4—

(viii) Benzyldimethyl cocoalkyl ammonium chlorides (e.g. R(CH3)2N+CH2C6H5 Cl—, etc.) ex AKZO-Nobel e.g. Arquad DMCB-80, DMHTB-75 Arquad M2HTB-80)

(ix) Cocobenzyl-(ethoxylated (2) -ammonium chloride (e.g. Ethoquad C12/B)

(x) Ethoxylated Quaternary Salts (Monoalkyl ethoxylates) i.e. monoalkyl methyl [ethoxylated (n)] ammonium chloride e.g. Ethoquat 18/12, i.e. octadecylmethyl [ethoxylated (2)], Ethoquad 18/25, Ethoquad C/12, C/25, Ethoquad O/12, i.e. Oleylmethyl [ethoxylated (2)], ethoquad C/12 nitrate, i.e. cocomethyl [ethoxylated (2)] ammonium nitrate, Ethoquad T/12 i.e. Tallowalkylmethyl [ethoxylated (2)]-ammonium chloride.

Optional Other Surfactants

If desired, nonionic surfactant may also be included. The amount of these materials, in total, is preferably from 0.1% to 7%, more preferably from 0.5% to 4%, especially from 0.9% to 3% by weight of the composition.

Preferred nonionic surfactants are aliphatic alcohols having an average degree of ethoxylation of from 2 to 12, more preferably from 3 to 10. Preferably, the aliphatic alcohols are $C_{10}$–$C_{16}$, more preferably $C_{12}$–$C_{15}$.

Detergency Builders

The compositions of the invention, when used as laundry wash compositions, will generally also contain one or more detergency builders. The total amount of detergency builder in the compositions will typically range from 5 to 80 wt %, preferably from 10 to 60 wt % by weight of the total composition.

Inorganic builders that may be present include sodium carbonate, if desired in combination with a crystallisation seed for calcium carbonate, as disclosed in GB-A-1 437 950; crystalline and amorphous aluminosilicates, for example, zeolites as disclosed in GB-A-1 473 201, amorphous aluminosilicates as disclosed in GB-A-1 473 202 and mixed crystalline/amorphous aluminosilicates as disclosed in GB-A-1 470 250; and layered silicates as disclosed in EP-A-164 514. Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

When the aluminosilicate is zeolite, the maximum amount is 19% by weight.

The alkali metal aluminosilicate may be either crystalline or amorphous or mixtures thereof, having the general formula: 0.8–1.5 $Na_2O$. $Al_2O_3$. 0.8–6 $SiO_2$.

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP-A-384 070. Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Bleaches

Laundry wash compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB-A-2 123 044.

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium noanoyloxybenzene sulphonate (SNOBS). The novel quaternary ammonium and phosphonium bleach precursors disclosed in U.S. Pat. No. 4,751,015 and U.S. Pat. No. 4,818,426 and EP-A402 971, and the cationic bleach precursors disclosed in EP-A-284 292 and EP-A-303 520 are also of interest.

The bleach system can be either supplemented with or replaced by a peroxyacid. examples of such peracids can be found in U.S. Pat. No. 4,686,063 and U.S. Pat. No. 5,397,501. A preferred example is the imido peroxycarboxylic class of peracids described in EP-A-325 288, EP-A-349 940, DE-A-382 3172 and EP-A-325 289. A particularly preferred example is phtalimido peroxy caproic acid (PAP). Such peracids are suitably present at 0.1–12%, preferably 0.5–10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP-A-458 397, EP-A-458 398 and EP-A-509 787.

Enzymes

Laundry wash compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. Subtilis B. licheniformis*, such as the commercially available subtilisins Maxatase (Trade Mark), as supplied by Gist Brocades N.V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

Other Optional Minor Ingredients

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid(or fatty acid soap), a sugar, an acrylate or acrylate/maleate copolymer, or sodium silicate. One preferred powder structurant is fatty acid soap, suitably present in an amount of from 1 to 15 wt %.

Yet other materials that may be present in detergent compositions of the invention include sodium silicate; antiredeposition agents such as cellulosic polymers; inorganic salts such as sodium sulphate; lather control agents or lather boosters as appropriate; dyes; coloured speckles; perfumes; foam controllers; fluorescers and decoupling polymers. The list is not intended to be exhaustive.

Preparation of the Compositions

The compositions of the invention may be prepared by any suitable process.

The choice of processing route may be in part dictated by the stability or heat-sensitivity of the surfactants involved, and the form in which they are available.

For example, alpha-olefin sulphonate is robust, and is available in powder, paste and solution form.

Alkyl ether sulphate is more sensitive to heat is susceptible to hydrolysis, and is available as concentrated (e.g. about 70% active matter) aqueous paste, and as more dilute (e.g. 28.5 wt %) solution.

In all cases, ingredients such as enzymes, bleach ingredients, sequestrants, polymers and perfumes which are traditionally added separately (e.g. enzymes postdosed as granules, perfumes sprayed on) may be added after the processing steps outlined below.

Suitable processes include:

(1) drum drying of principal ingredients, optionally followed by granulation or postdosing of additional ingredients;

(2) non-tower granulation of all ingredients in a high-speed mixer/granulator, for example, a Fukae (Trade Mark) FS series mixer, preferably with at least one surfactant in paste form so that the water in the surfactant paste can act as a binder;

(3) non-tower granulation in a high speed/moderate speed granulator combination, thin film flash drier/evaporator or fluid bed granulator.

EXAMPLES

The invention is further illustrated by the following non-limiting Examples, in which parts and percentages are by weight unless otherwise stated.

| | 1 | A | 2 | B | 3 | C |
|---|---|---|---|---|---|---|
| AOS | 15 | 5 | 10 | 5 | 10 | 9.2 |
| LAS | | 10 | | 10 | | |
| SLES (3EO) | | | 5 | | 5 | |
| Alcohol 7EO ethoxylate nonionic | | | | 2 | 2 | |
| Cationic Praepagen HY | 12.5 | 12.5 | 12.5 | 12.5 | 12.5 | 12.5 |
| $Na_2CO_3$ | 25 | 25 | 25 | 25 | 25 | 25 |

-continued

| | 1 | A | 2 | B | 3 | C |
|---|---|---|---|---|---|---|
| STP | 35 | 35 | 35 | 35 | 35 | 35 |
| Enzymes | 0.7 | 0.7 | 0.7 | 0.7 | 0.7 | 0.7 |
| SCMC | 2 | 2 | 2 | 2 | 2 | 2 |
| Fluorescer | 0.2 | 0.2 | 0.2 | 0.2 | 0.2 | 0.2 |
| Perfume | 0.5 | 0.5 | 0.5 | 0.5 | 0.5 | 0.5 |
| Moisture & impurites | Balance to 100% | | | | | |

Detergency Testing

Examples 1–3 are of the invention. Examples A–C are controls. Examples 1–3 showed measurably superior greasy/oily soil removal in a quantitative test.

What is claimed is:

1. A powder laundry detergent composition comprising:

(a) at least 5 wt % of a calcium-tolerant non-soap anionic surfactant system which comprises an alpha-olefin sulphonate and alkyl ether sulphate in a weight ratio of from 5:1 to 15:1;

(b) at least 0.1 wt % of a cationic surfactant system in a weight ratio of (a):(b) of from 17:3 to 9:10;

(c) a laundry detergent ingredient selected from the group consisting of fluorescer and anti-redeposition agent;

(d) 5% to 80% by weight of a detergent builder; and (e) the balance, if any, being other detergent ingredients.

2. The detergent composition of claim 1, which comprises at least 15 wt % of the anionic surfactant system (a).

3. The detergent composition of claim 1, comprising from 0.5 wt % to 5 wt % of the cationic surfactant system.

4. The detergent composition according to claim 1, wherein the cationic surfactant system comprises one or more cationic surfactants selected from compounds of formula:

$$R^1R^2R^3R^4N^+X^-$$

wherein $R^1$ is a hydrophobic group;

$R^2$,$R^3$ and $R^4$ are independently selected from hydroxyethyl, hydroxyproply and $C^{1-4}$ alkyl; and $X^-$ is a solubilising cation.

5. The composition according to claim 1, comprising from 5% to 45% by weight of detergency builder.

6. The powder detergent composition of claim 1, wherein components (a) and (b) are contained in separate granules, each respectively excluding the other component.

7. The composition of claim 1 wherein the weight ratio of (a):(b) is from 3:1 to 1:1.

* * * * *